United States Patent [19]

Radek

[11] Patent Number: 4,607,753

[45] Date of Patent: Aug. 26, 1986

[54] SLOTTED WALL MERCHANDISE DISPLAY PANEL

[75] Inventor: John R. Radek, Hinsdale, Ill.

[73] Assignee: Ready Metal Manufacturing Company, Chicago, Ill.

[21] Appl. No.: 626,532

[22] Filed: Jun. 29, 1984

Related U.S. Application Data

[63] Continuation-in-part of Ser. No. 508,571, Jun. 28, 1983, abandoned.

[51] Int. Cl.[4] ..... A47F 5/08

[52] U.S. Cl. ..... 211/87; 52/36; 52/588; 211/94; 211/189; 248/222.2

[58] Field of Search ..... 211/87, 94, 189, 59.1, 211/57.1; 248/220.2, 222.1, 222.2, 245, 220.3, 220.4; 52/588, 36, 357, 359

[56] References Cited

U.S. PATENT DOCUMENTS

| | | | |
|---|---|---|---|
| 3,352,428 | 11/1967 | Sak et al. | 211/87 |
| 3,969,866 | 7/1976 | Kyne | 52/588 |
| 4,049,230 | 9/1977 | Minniear | 248/231.2 X |
| 4,323,163 | 4/1981 | Johns | 52/588 X |
| 4,420,087 | 12/1983 | Johns | 52/588 X |
| 4,434,900 | 3/1984 | Cook | 52/36 X |
| 4,450,970 | 5/1984 | Shepherd | 52/588 X |

FOREIGN PATENT DOCUMENTS

| | | | |
|---|---|---|---|
| 2215563 | 10/1973 | Fed. Rep. of Germany | 248/221.1 |

*Primary Examiner*—Robert W. Gibson, Jr.
*Attorney, Agent, or Firm*—Samuel Lebowitz

[57] ABSTRACT

Support Panel for cantilever hangers or the like for use especially in a retail store for display of small items of merchandise. Display equipment of this general character has been known and used in self-service stores, where a customer selects an item from an open display on cantilever arms detachably mounted on a vertically disposed "pegboard." In the past such panels have usually been formed of wood, plywood or the like, possibly secured to a baseboard of stiff material such as sheet steel to provide necessary strength and rigidity. The present invention contemplates a composite panel comprising a plurality of narrow slatlike plates of sheet metal, plastic or other suitable material mounted in parallel horizontal relation. The "slats" are flanged along their longitudinal edges to permit their nesting or interengagement as well as to provide a longitudinal groove or recess for engaging a terminal member on one end of a cantilever hanger, to permit engagement of the hangers at many points along such groove, said flanges also stiffening the slats. The slats may be perforated or imperforate to provide for support of hangers with a variety of terminal support members for attachment to the board. Thus, a hanger may have a terminal hook formed by bending the rod, said hook seatable in the groove; or it may have wire prongs seatable in selected perforations in a slat, or a combination of such attachment means.

11 Claims, 19 Drawing Figures

FIG. 1
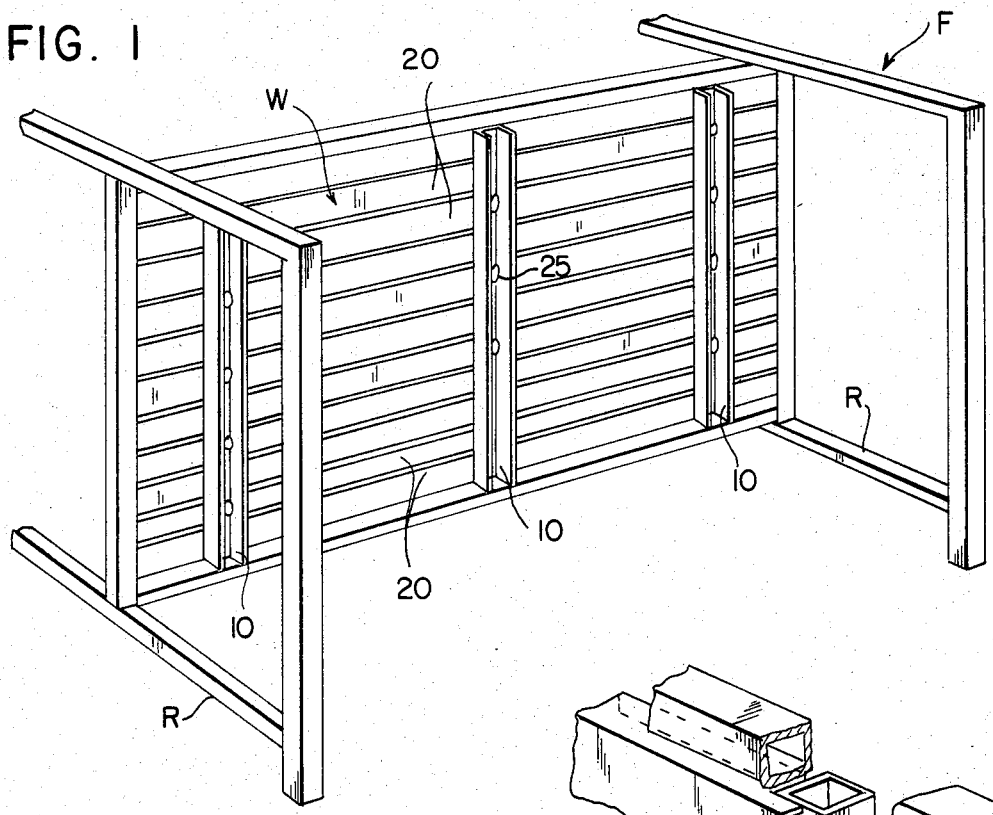
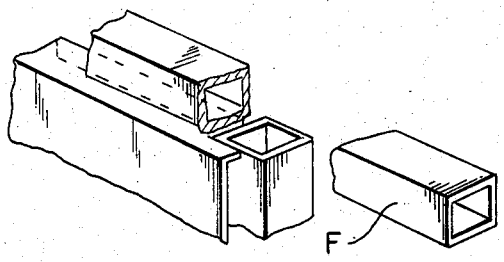
FIG. 9
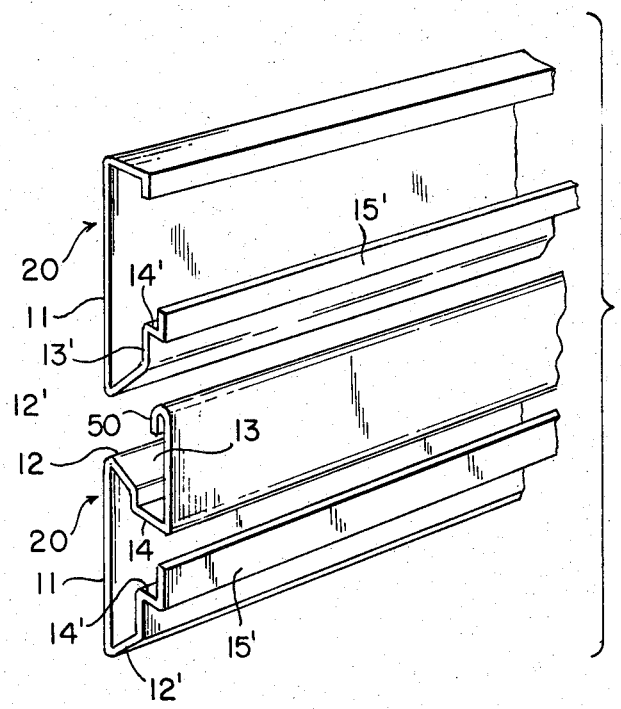
FIG. 4

FIG. 5
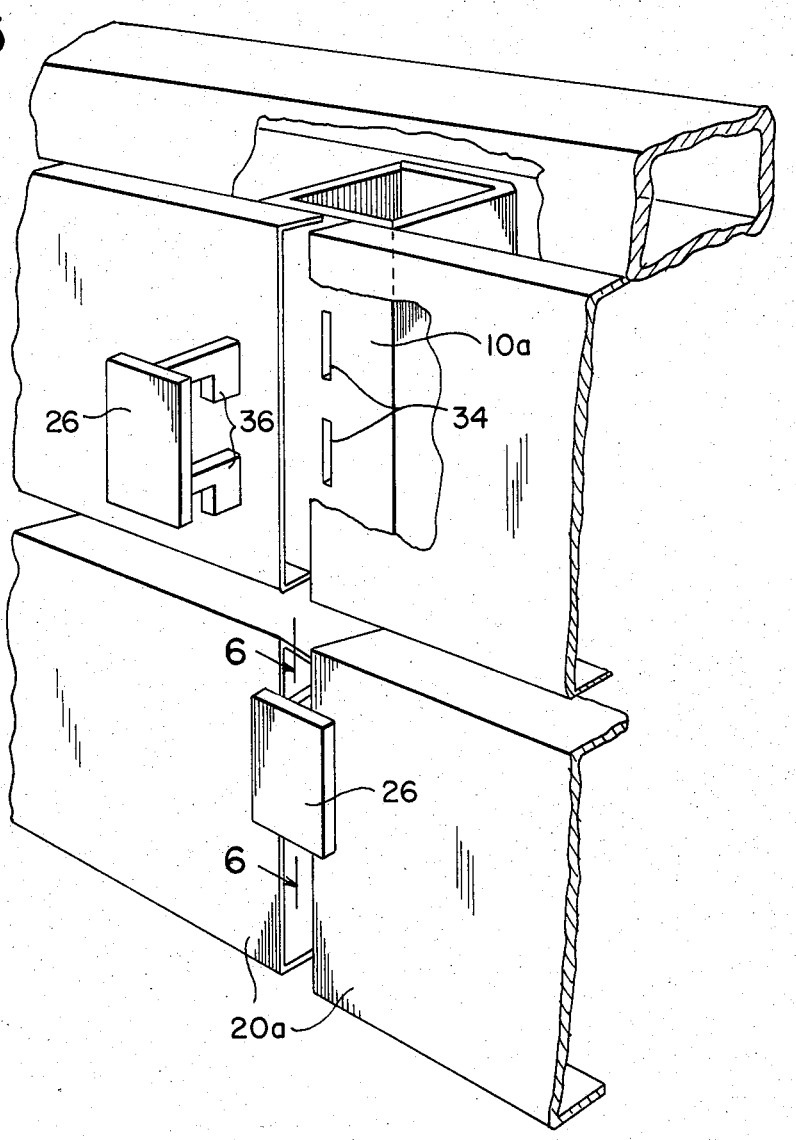
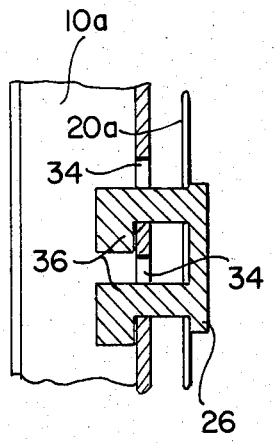
FIG. 6
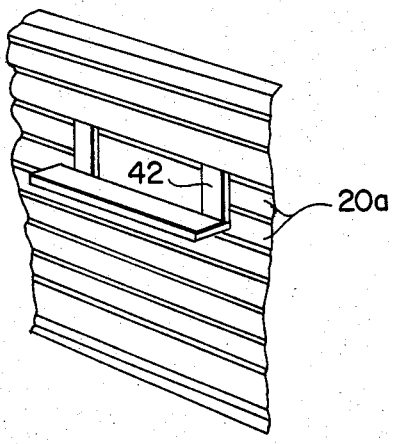
FIG. 7
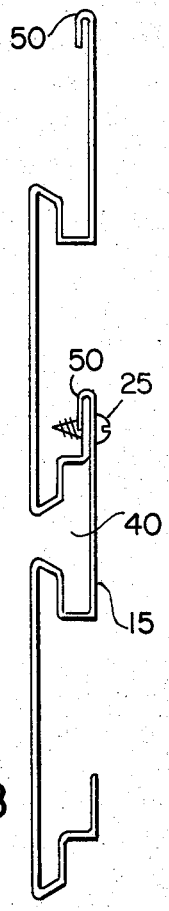
FIG. 8

115
H
P
128
160
18
150
126
122
120
112
P1
125
127
100
105
102

SLOTTED WALL MERCHANDISE DISPLAY PANEL

This application is a continuation in part of my copending application Ser. No. 508,571, filed June 28, 1983, now abandoned.

My invention relates generally to merchandise display equipment for retail stores and the like, especially in so-called self-service stores where small items are displayed for selection by the customer.

More particularly, my invention has to do with a composite panel normally disposed in a vertical plane and supporting a plurality of cantilever arms or hangers removably attached to said panel for the support of small items such as, for example, hand tools or other small hardware items.

My invention has to do especially with improvements in such panels by provision of a plurality of narrow interengaging slats arranged in parallel horizontal relation, perforated or imperforate, whereby to permit attachment of cantilever hangers having a variety of terminal attachment means.

BACKGROUND

Illustrative of the prior art relating to my invention is Radek U.S. Pat. No. 3,677,411 issued July 18, 1972. Said patent shows cantilever hangers of a type sometimes employed with my improved panel. Frames suitable for supporting such panels are disclosed in my U.S. Pat. No. 4,093,078 dated June 6, 1978.

Heretofore, it has been customary to provide a panel (usually perforated) formed of wood, plywood or the like glued or otherwise secured to a board of rigid material such as metal to provide a base of adequate strength for the support of cantilever hangers and goods carried thereby.

BRIEF OUTLINE OF INVENTION

In brief, my invention contemplates improvements in a vertically disposed panel for the display of merchandise for sale in a self-service store by cantilever hangers detachably mounted on said wall or panel.

According to my invention, the panel, instead of comprising a generally integral wall providing a more or less unbroken vertical planar surface except for perforations to receive prongs on the end of the hanger, comprises a series of horizontally disposed, parallel slatlike plates. The marginal edges of said slats are flanged to permit interengagement as well as a longitudinally extending groove to seat terminal support members on the hangers at a large number of positions on the panel.

Said slats may be imperforate or provided with horizontally spaced perforations to seat wire prongs of support elements carried by the cantilever hangers.

One advantage of my invention is simplification of the hanger when seatable in said grooves, and also to permit attachment of hangers provided with a variety of support devices, viz., comprizing wire prongs seatable in the perforations as well as hangers lacking such prongs.

My improved composite wall is stronger and lighter in weight, and not substantially more expensive, as compared with integral walls of the prior art.

Various other objects and advantages may become apparent to those skilled in the art as the description proceeds.

BRIEF DESCRIPTION OF DRAWINGS

Referring now to the drawings forming a part of this specification and illustrating preferred embodiments of my invention, FIG. 1 is a fragmentary rear perspective view of a display setup including a panel embodying my invention;

FIG. 4 is a fragmentary exploded perspective showing the relation of assembled slats;

FIG. 5 is a further enlarged fragmentary perspective of a pair of assembled slats in another embodiment;

FIG. 6 is a sectional view substantially along line 6—6 of FIG. 5;

FIG. 7 is a fragmentary front perspective showing another type of merchandise support;

FIG. 8 is a side elevation showing details of construction;

FIG. 9 is a fragmentary exploded perspective showing the relation of my improved wall to a supporting frame;

DETAILED DESCRIPTION

Figure 2:
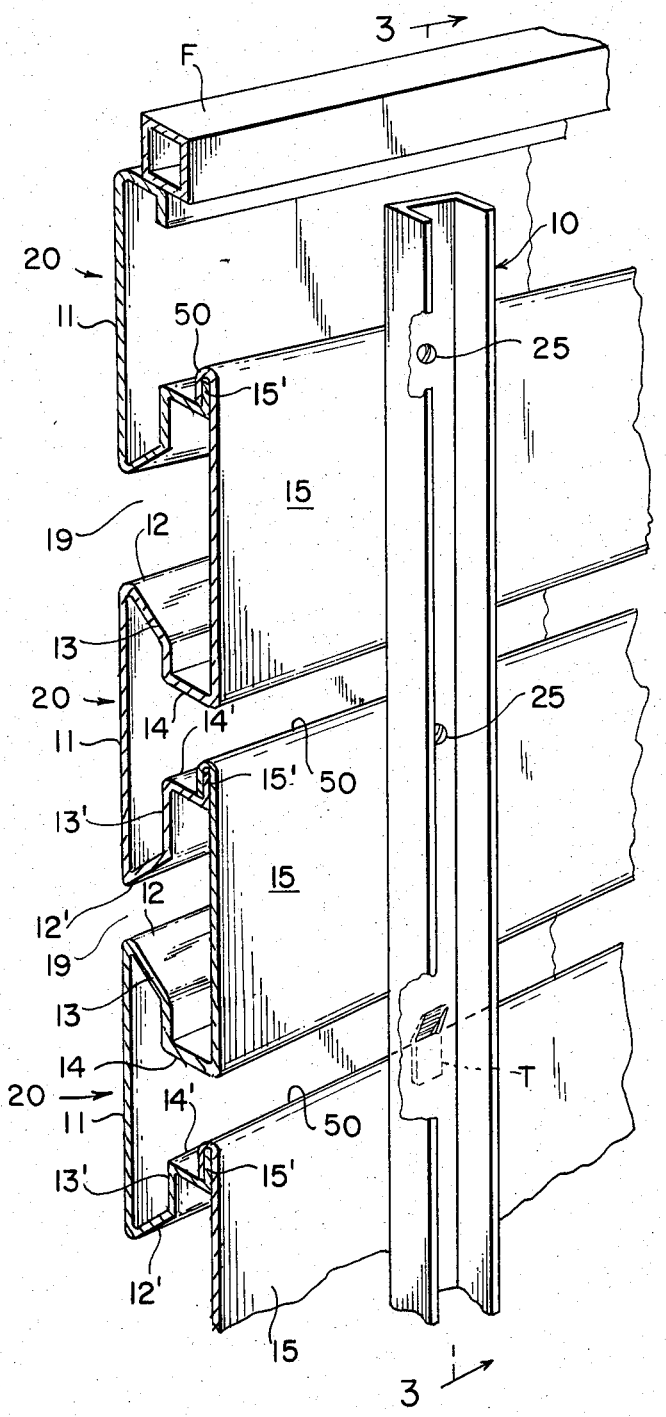
FIG. 2 is a fragmentary rear perspective on an enlarged scale showing the wall in greater detail.

FIG. 1 shows an imperforate form of composite wall embodying my invention, it being understood that perforated walls employing cantilever hangers with wire-pronged attachment means may likewise be employed in my invention. My improved wall W is shown mounted for convenience on a frame F that may be constructed according to my U.S. Pat. No. 4,093,078, formed of rectangular metal tubing. The frame may be tandem as shown, with outriggers R for providing desired support for the assembly.

Panel W may be attached to horizontally spaced vertical struts 10, which may be suitable steel shapes such as channel members or the like, said panel being attached to the frame by suitable detachable means such as screws 25 or clips 35 (FIGS. 5–6).

The panel W is formed of a plurality of superposed horizontally extending substantially parallel slats 20 of rigid sheet material. These slats may be formed preferably of sheet metal, possibly coated with a thin layer of plastic with a desired finish, such as wood grain. Each slat other than those attached to the top and bottom beams of the mounting frame F (FIG. 9) is formed as a trapezoidal section at the front thereof so that the bases 11 of these trapezoidally contoured slats lie in a common vertical plane to form the front of the panel or wall W. Short lengths 12,12' are bent at acute angles rearwardly from the opposite edges of each base 11 to form passages 19 between adjacent slats which diverge or flare rearwardly from the front of the wall.

A short length 13 of the sheet material is bent downwardly in a vertical plane from member 12 followed by a horizontal shelf portion 14 which at its rear edge is bent upwardly into a vertical terminal leaf portion 15. Similarly, the allochiral relation of the elements at the opposite top and bottom edges of each slat is carried forth by bending the lower edge of the slat 11 at an acute angle into inclined portion 12' followed by an upwardly extending portion 13', horizontal shelf portion 14' and vertical terminal leaf portion 15'.

Figure 3:
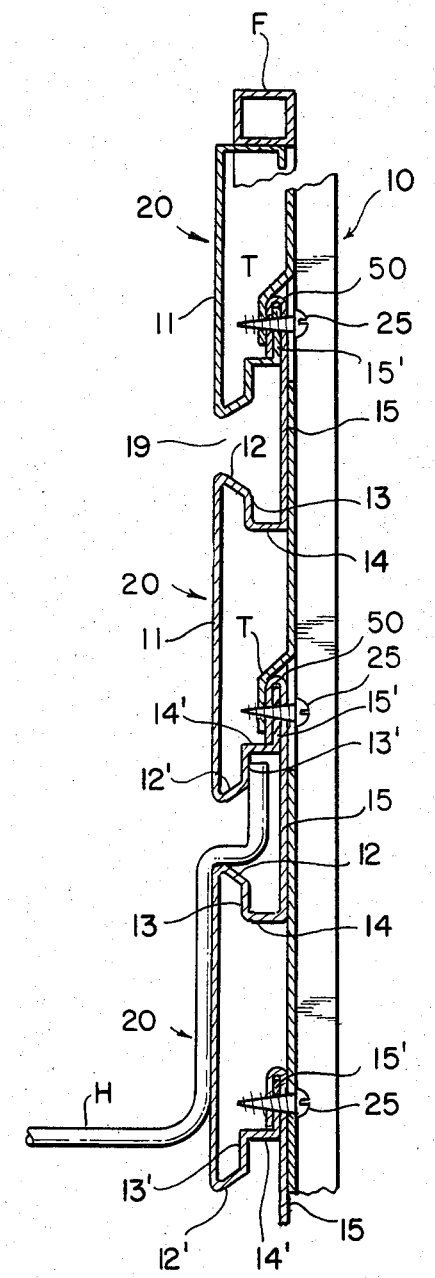
FIG. 3 is a vertical section taken substantially along line 3—3 of FIG. 2.
Figure 3A:
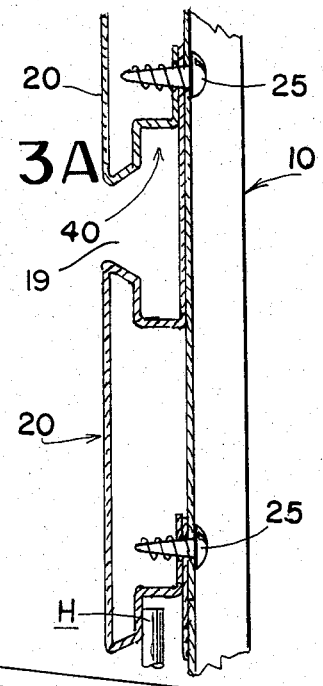
FIG. 3A is a fragmentary vertical section similar to FIG. 3 but lacking tabs T.

The shelf portion 14 at the top of the slat is slightly wider than the shelf portion 14' at the bottom of the adjacent superposed slat so that the terminal leaf portions 15 and 15' of adjacent slats are in juxtaposition for interconnection by any suitable means. In FIGS. 3 and 3A, detachable self-tapping fastening screws 25 are shown for effecting this connection, which at the same time may serve as means for connecting the panels 20 to the spaced struts 10 at the rear of the wall by the self-tapping screws 25 piercing, as well, tabs T stamped from the vertical struts. These connecting means are invisible from the front of the wall despite the relatively wide horizontal gaps therebetween.

In the embodiments shown in FIGS. 2, 4 and 8, the detachable fastening means are in the form of a forwardly and downwardly extending lip 50 at the top of the flange or vertical leaf portion 15 fitting over the top edge of the flange or leaf portion 15' adjacent to the lower edge of the slat thereabove.

The slats are so formed and disposed as to provide a substantially continuous longitudinally extending recess of cavity 40 of substantially rectangular between adjacent slats which merges with the outlet of the flaring passage 19. Said cavity is designed to seat a terminal hooklike deformation 42 offset from the rear end of a cantilever hanger H. Thus, the cantilever merchandise hanger or support H may be disposed at an infinite number of positions horizontally of the wall and the insertion thereof into the spaces between the slats is rendered facile and easy because these are relatively wide at the inlets on the front of the wall and no sharp rectangular corners are encountered in the course of seating the mounted bodies within the cavities 40. Thus, as shown in the sectional views, FIGS. 3 and 3A, the inlets of the flaring passages 19 between the slats are approximately one-fourth of the width of the slats, and the passages 40, of substantially rectangular section, for seating the attached bodies are approximately one-half the width of the slats. The passages 40 are arranged symmetrically with respect to the inlet passages 19.

The terminal leaf portions of the slats have a tight frictional interengagement (FIG. 3) to secure a rigid composite wall. Screws 25 or the like may be employed to secure the panel to struts 10. (See FIGS. 3, 3A.)

FIGS. 5 and 6 show another arrangement for utilizing a composite slatted wall for merchandise display. Here struts **10*a* may be perforated to provide slots 34 for attachment of binding members 26 for securing together slats 20*a*. Such binding members may comprise a head portion 26 with integral hook members 36, 36** and may conveniently be formed of molded plastic, metal or the like.

It is apparent that such binding members serve to clamp the slats securely to the frame with little or no risk of inadvertent disengagement.

FIG. 7 shows attached to a wall embodying my invention a somewhat different type of merchandise support essentially of cantilever design, comprising a ledge or shelf carried by one or more hook members 42 detachably seatable in the groove between a pair of adjacent slats.

Figure 10:
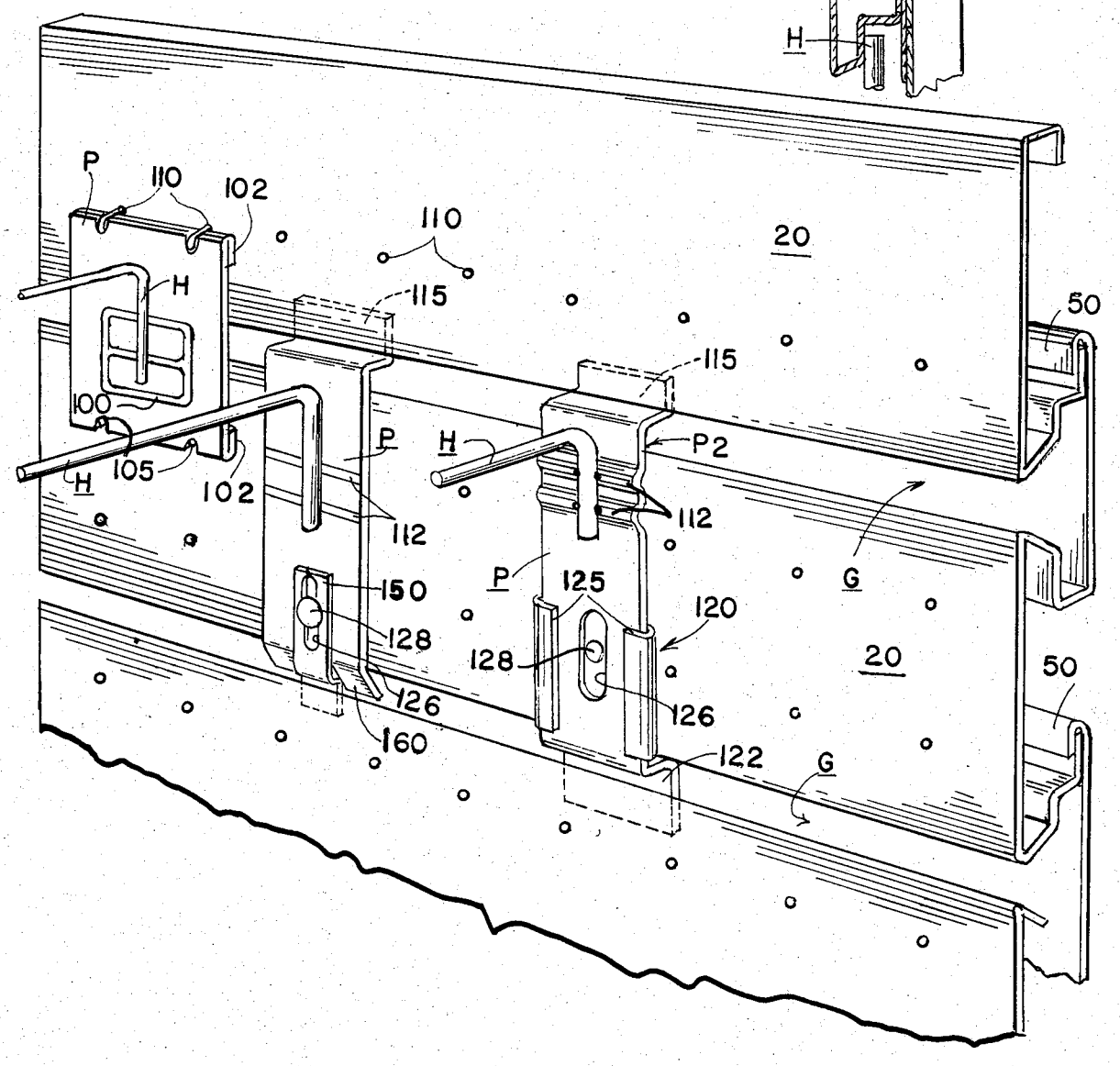
FIG. 10 is a fragmentary enlarged perspective showing a plurality of perforated slats embodying my invention with different types of hangers detachably mounted thereon.

In FIG. 10 is shown a universally adaptable slotted wall merchandise panel which is capable of accommodating cantilever hangers of all types including those fitted with prongs for mounting on conventional peg boards, of the type shown in my above-mentioned U.S. Pat. No. 3,677,415. In this construction the panels 20 are provided with perforations aligned in horizontal and vertical directions for the reception of prongs of all types as shown in said patent. In addition, FIG. 10 shows cantilever hangers on plates of special design which may be mounted anywhere on the panel within the horizontally extending slots provided in the improved panel.

My invention also includes certain improved hangers especially suitable for merchandise display in connection with my improved wall panel.

FIGS. 10–13, inclusive, shows a hanger H attached as by spot welding to a plate P, say of metal or the like, of suitable size to support a single cantilever hanger of rod-like formation. Said plate is embossed as at 100 to provide a secure seat for hanger H.

End portions of plate P are bent to provide opposed flanges 102, 102 disposed behind plate P and perforated to seat opposed tenuous, channel shaped hook members 105, 105', at the top and bottom of plate P, respectively.

Figures 11, 12, 13, 14, 15, 16, 17, 18:
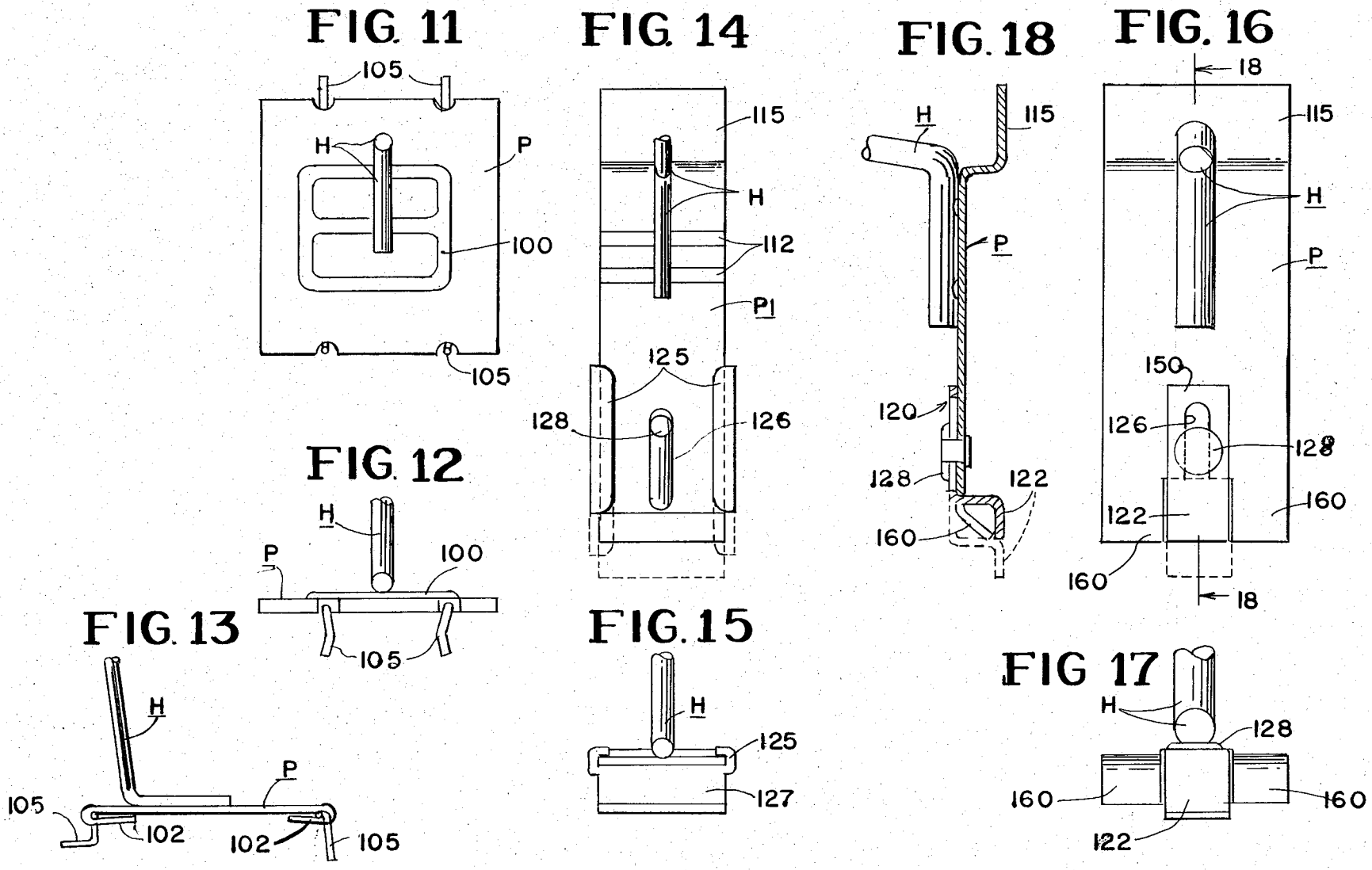
FIG. 11 is a front elevation of a hanger employable with a perforated version of my improved wall.
FIG. 12 is a fragmentary plan view of the free end portion of the hanger of FIG. 11.
FIG. 13 if a similar view of the inner end portion of same.
FIG. 14 is a fragmentary front elevation of another type of hanger with lock-on feature.
FIG. 15 is a top plan view of the inner end thereof.
FIG. 16 is an elevation of another lock-on hanger.
FIG. 17 is a plan view of free end of version of FIG. 16.
FIG. 18 is a sectional view substantially along line 18—18 of FIG. 16.

As seen in FIG. 13, one pair of hooks, say the upper ones, is normally bent at the ends to provide upwardly extending terminal portions, the lower hooks extending outwardly.

Thus, to seat on a panel 20, the plate P is brought into juxtoposition to a panel 20, the upper prongs moved laterally through a pair of wall perforations 110 and the lower prongs then moved laterally to seat in a pair of wall perforations (FIG. 10).

As seen in FIGS. 10, 14 and 15, in this embodiment no tenuous attachment means is needed, the hanger seating in a pair of opposed grooves G in the panel. A plate P1 is deformed to provide embossed ridges 112 to which hanger H may be spot welded. The upper extremity of plate $P_1$ is bent to provide an angular seating member 115 (FIG. 10) engageable in an upper groove G between adjacent slats 20.

To the lower part of plate $P_1$ is slideably attached a locking plate 120 having an offset rectangular end portion 122 seatable in a lower groove G. Slideable plate 120 has side flanges 125, 125 embracing side edges of plate $P_1$ and slotted as at 126.

Plate P may be slotted as at 127 to permit passage of a rivet or set screw 128 to engage sliding plate 120. To attach this hanger to a wall panel of my invention, flange 115 is disposed in an upper groove G (FIG. 10) and the angular portion 122 is slid down into position in lower groove G to secure the hanger in a selected position on the wall.

FIGS. 10 and 16–18, inclusive, show a variation of the last described hanger, likewise dispensing with tenuous attaching means. This embodiment is substantially similar to that of FIGS. 14 and 15 in that it is engageable in upper and lower grooves G adjacent a slat. However, the slideable plate 150, slotted at 126', has no embracing side flanges as in the last described embodiment. Plate $P_2$ at its lower extremity has rearwardly bent flanges 160 for seating in a lower groove G. Operation of this embodiment is believed clear from this description.

CONCLUSION

It will be seen that I have provided an improved merchandise display panel of composite slatted construction, with new and improved cantilever display hangers specially adapted for use in connection with such a panel.

Various changes may suggest themselves to those skilled in the art without departing from the spirit of my invention. Hence, I do not wish to be restricted except to the extent indicated by the appended claims.

I claim:

1. A slotted panel for display of merchandise disposed on cantilever hangers of all types detachably mounted on the front of said panel, and said panel detachably connected to supporting means therefor at the rear thereof, comprising (a) a plurality of superposed horizontally extending substantially parallel slats of rigid sheet material, each formed of trapezoidal section at the front thereof, so that the bases of the trapezoidally contoured slats lie in a common vertical plane with the opposite edges of each of the bases bent at acute angles rearwardly therefrom to form divergent portions between adjacent slats and corresponding rearwardly flaring slots therebetween, (b) short lengths of said rigid sheet material extending from said divergent portions in vertical planes parallel to said bases, (c) extensions from said short lengths defining cavities of substantially rectangular section between adjacent slats and said extentions terminating in vertical leaf portions with the extremities of adjacent slat vertical leaf portions in juxtaposition, and (d) detachable fastening means for interconnecting the juxtaposed extremities of adjacent slats, and (e) said panel adapted to receive a cantilever merchandise hanger having a terminal member adapted to be seated within any one of said slots at any point of the length thereof.

2. The combination set forth in claim 1, wherein said detachable fastening means are self-tapping screws.

3. The combination set forth in claim 2, wherein said self-tapping screws are also in detachable engagement with said first-mentioned supporting means for said slotted panel.

4. The combination set forth in claim 1, wherein said slats are provided with parallel rows of perforations arranged in aligned horizontal and vertical directions for the accommodation of conventional cantilever merchandise hangers provided with prongs for selective penetration into said perforations.

5. The combination set forth in claim 1, wherein each flaring slot between adjacent slats at the front of the panel is approximately one-fourth of the width of the slats and the height of each cavity of substantially rectangular section is approximately one-half the width of the slats.

6. The combination set forth in claim 1, wherein said last-mentioned cantilever merchandise hanger includes a second terminal member at the lower portion thereof slidably mounted with respect to said first terminal member for movement within the flaring slot immediately below the slot seating said terminal member at the upper portion of said hanger.

7. A slotted panel for display of merchandise disposed on cantilever hangers of all types detachably mounted on the front of said panel, and said panel detachably connected to supporting means therefor at the rear thereof, comprising (a) a plurality of superposed horizontally extending substantially parallel slats of rigid sheet material, each formed of trapezoidal section at the front thereof, so that the bases of the trapezoidally contoured slats lie in a common vertical plane with the opposite lower and upper edges of each of the bases bent at acute angles rearwardly therefrom to form divergent portions between adjacent slats and corresponding rearwardly flaring slots therebetween, (b) short lengths of said rigid sheet material extending from said divergent portions in vertical planes parallel to said bases, (c) short transverse shelf portions extending rearwardly from said last-mentioned short vertical lengths with terminal flanges extending in vertical planes upwardly therefrom, the shelf portion adjacent to the lower edge of each slat being slightly shorter than the shelf portion adjacent to the upper edge of the slat therebelow, whereby the terminal flanges of adjacent slats are in juxtaposition, (d) detachable fastening means for interconnecting the juxtaposed portions of said last-mentioned terminal flanges, and (e) a cantilever merchandise hanger having a terminal member at least at the upper portion thereof insertable through any part of a flaring slot into the space between adjacent shelf portions for confinement therein.

8. The combination set forth in claim 7, wherein said detachable fastening means are self-tapping screws.

9. The combination set forth in claim 8, wherein said self-tapping screws are also in penetrating engagement with said first-mentioned supporting means.

10. The combination set forth in claim 7, wherein the terminal flange extending from the shelf portion adjacent to the upper edge of each slat is provided with a downwardly extending lip forwardly of the free end of the terminal flange extending from the shelf portion adjacent to the lower edge of the superposed slat and which is adapted for nesting engagement therewith.

11. The combination set forth in claim 7, wherein said last-mentioned cantilever merchandise hanger includes a second terminal member at the lower portion thereof slidably mounted with respect to said first terminal member for movement within the flaring slot immediately below the slot seating said terminal member at the upper portion of said hanger.

* * * * *